US006287162B1

(12) United States Patent
Freitag et al.

(10) Patent No.: US 6,287,162 B1
(45) Date of Patent: Sep. 11, 2001

(54) BEARING ARRANGEMENT FOR DRIVE SHAFT OF WATER JET APPARATUS

(75) Inventors: Michael W. Freitag; Paul E. Westhoff, both of Kenosha, WI (US); Richard M. McChesney, Waukegan, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/469,594

(22) Filed: Dec. 24, 1999

(51) Int. Cl.[7] ..... B63H 5/10
(52) U.S. Cl. ..... 440/82; 440/42; 440/83
(58) Field of Search ..... 440/38, 69, 78, 440/82, 83

(56) References Cited

PUBLICATIONS

Outboard Marine Corporation Turbojet, exploded view of housings and drive shaft, commercially available product, 3 sheets.

Polaris PWC, exploded views of driveshaft/coupler and pump assembly, commercially available product, 2 sheets.

Mercury Sportjet, exploded views of pinion & impeller shaft and hozzle rudder components, commercially available product, 2 sheets.

*Primary Examiner*—S. Joseph Morano
*Assistant Examiner*—Ajay Vasudeva
(74) *Attorney, Agent, or Firm*—Dennis M. Flaherty

(57) ABSTRACT

A water jet apparatus having a single drive shaft rotatably supported by a pair of bearings installed in an inlet housing. The impeller is securely mounted on a splined end of the drive shaft which extends out of the inlet housing in the aft direction. The drive shaft is not supported by the stator housing, thereby eliminating the need to install bearing inside the stator housing during assembly. Oil seals are arranged between the drive shaft and an inlet housing projection which extends into a cavity formed in the front end of the impeller.

18 Claims, 6 Drawing Sheets

BEARING ARRANGEMENT FOR DRIVE SHAFT OF WATER JET APPARATUS

FIELD OF THE INVENTION

This invention generally relates to water jet apparatus for propelling boats and other watercraft. In particular, the invention relates to mechanisms for transmitting motive power from an inboard marine engine to a water jet apparatus.

BACKGROUND OF THE INVENTION

The powerhead of a boat or any other watercraft can be placed either inside (inboard) or outside (outboard) the hull of the boat. In both cases, a water jet apparatus can be mounted outside the boat at a certain depth below the waterline.

For example, it is well-known to retrofit a water jet on an outboard motor in place of a propeller. In such a system, a rotor or impeller is mounted (e.g., spline fitted) directly on the propeller output shaft in place of the propeller. There are typically no modifications to the drive train, cooling or sealing components. A housing having a water inlet and a water outlet surrounds the rotor.

A water jet system has the advantages of protecting the rotating elements from interference with and damage by foreign objects in the water, and improving some aspects of performance of the propulsion system. Another benefit inherent with the water jet is a directed jet of water that results in greater steering response at speed.

To facilitate use of water jet-propelled boats in shallow water, it is known to mount the water jet at an elevation such that the water jet does not project below the bottom of the boat hull. This can be accomplished, for example, by installing a duct in the stern of the boat, the duct being arranged to connect one or more inlet holes formed in the bottom of the hull with an outlet hole formed in the transom. The water jet is then installed outside the hull in a position such that the water jet inlet is in flow communication with the duct outlet at the transom.

Alternatively, some water jets are designed with an inlet housing which is built into the hull such that the inlet lies in the plane of the hull bottom. In a typical design, an inlet housing which rotatably supports a first shaft is mounted to the boat hull, and then a stator housing which rotatably supports a second shaft is attached to the inlet housing. The impeller is securely mounted on the forward end of the second shaft and has a splined bore for receiving a splined end of the first shaft when the inlet and stator housing are coupled. This conventional arrangement requires two sets of bearings: one set installed in the inlet housing for rotatably supporting the first shaft at two axial positions therealong and another set installed in the stator housing for rotatably supporting the second shaft at two axial positions therealong.

There is a need for a water jet apparatus having a simplified design which is relatively easier to mount onto a boat hull.

SUMMARY OF THE INVENTION

The present invention is directed to a water jet apparatus which has a single drive shaft rotatably supported by a pair of bearings installed in an inlet housing. The impeller is securely mounted on a splined end of the drive shaft which extends out of the inlet housing in the aft direction. The drive shaft is not supported by the stator housing, thereby eliminating the need for bearings inside the stator housing.

In accordance with the preferred embodiment of the invention, the inlet housing comprises a vertical strut having an axial bore which houses a portion of the drive shaft, both ends of the drive shaft projecting out of the bore. Toward the forward end of the drive shaft, the drive shaft is rotatably supported by a forward bearing installed in an annular space between the drive shaft and a bearing housing. The bearing housing in turn has a generally annular portion which extends into an annular cavity formed between the inlet housing and the bearing, and a generally radial flange with holes for screwing the bearing housing to the inlet housing. At a position to the rear of the forward bearing, an aft bearing is installed in an annular space formed between the drive shaft and the inlet housing. The inlet housing comprises a generally annular projection which extends in the aft direction into a cavity formed in the forward section of the impeller hub. Oil seals are installed between the generally annular projection of the inlet housing and the drive shaft. The impeller is held securely on the drive shaft by a lock nut.

Thus, in accordance with the preferred embodiment of the invention, the impeller is mounted on a distal section of a drive shaft having no bearing support aft of the impeller. As a result, the second shaft of the conventional drive shaft arrangement is eliminated. Moreover, the assembly of the water jet apparatus is simplified since no bearing assemblies need to be installed in the stator housing.

DETAILED DESCRIPTION OF THE PREFERRED EMBODIMENTS

Figures 1, 1A, 1B:
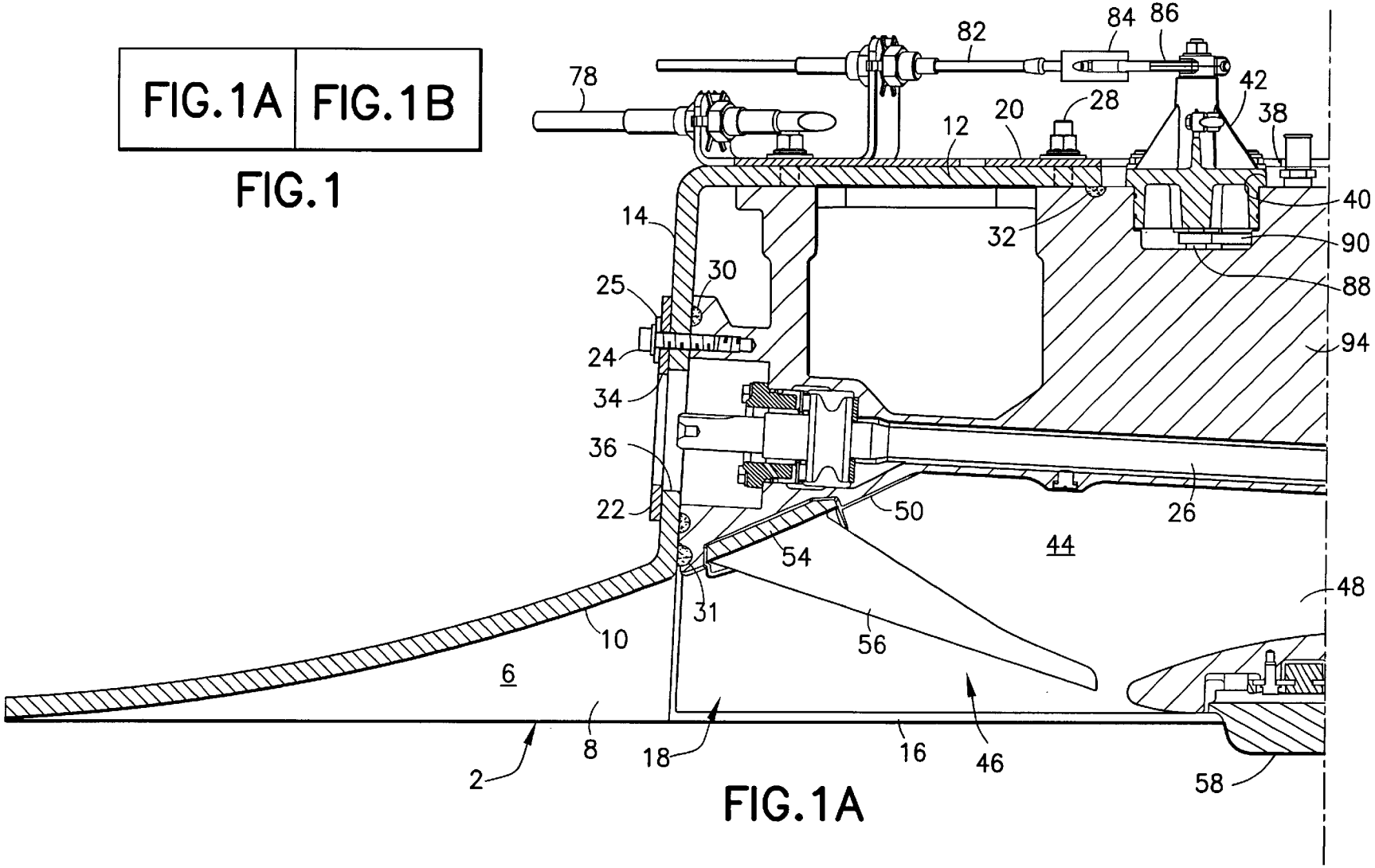
FIG. 1 is a schematic (presented in two sheets respectively labeled FIGS. 1A and 1B) showing a sectional view of a water jet apparatus in accordance with a preferred embodiment of the invention, the section being taken along a vertical midplane.
Figure 1B:
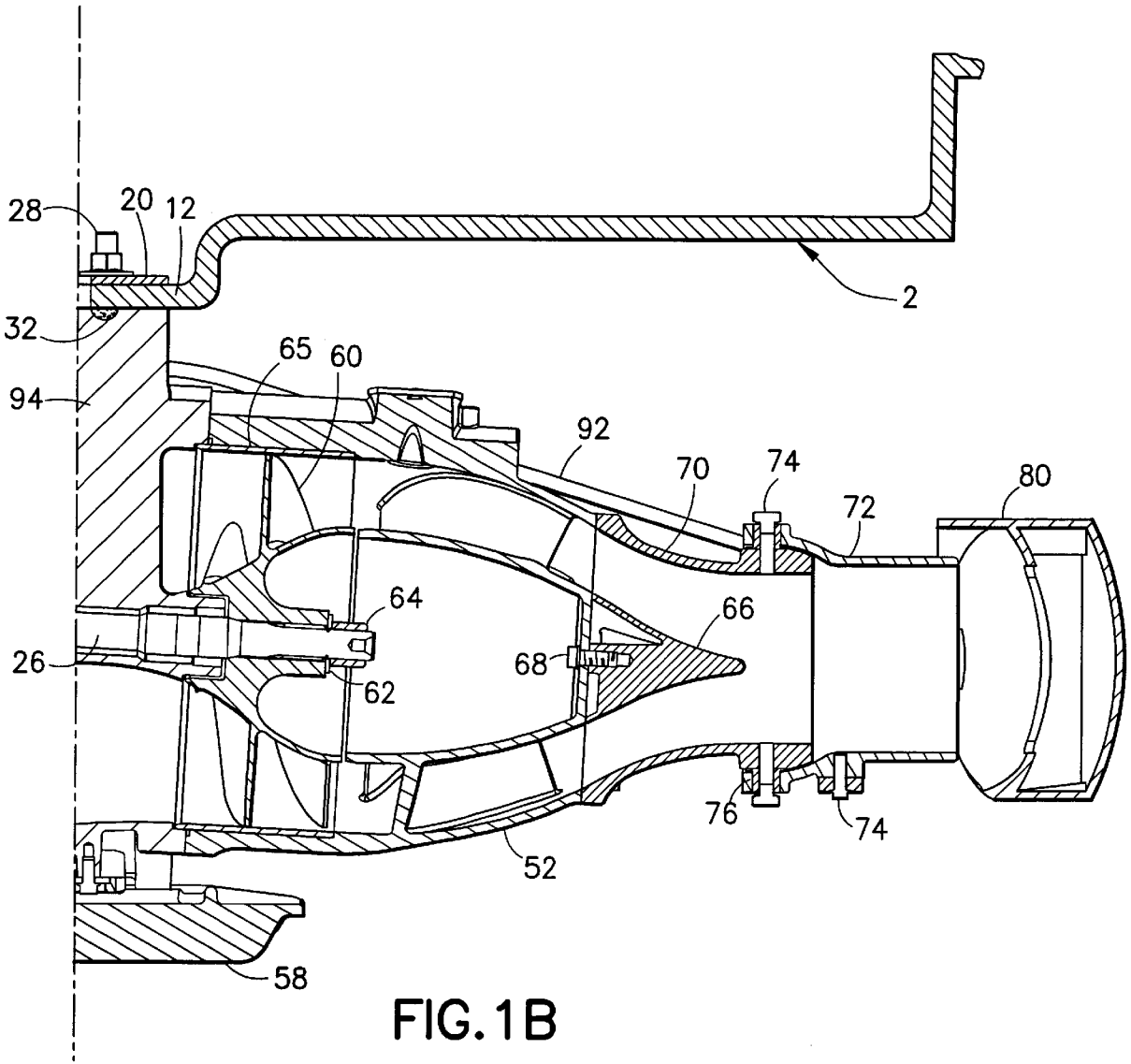

The present invention is a drive shaft bearing arrangement for use in a water jet apparatus driven by an inboard motor. As seen in FIG. 1, the water jet apparatus is designed to be installed in a cavity under a section of the hull and in flow communication with the outlet of an inlet ramp built into the hull. As seen in FIG. 1, the boat hull 2 has an inlet ramp 6 formed by a pair of opposing sidewalls 8 and a ramp surface 10 which curves gently upward in the aft direction. The end of the inlet ramp 6 is in flow communication with a cavity in which the water jet apparatus is installed. This cavity for the water jet apparatus is defined by a horizontal hull section 12, a vertical hull section 14 and a pair of opposing sidewalls 16 (only one of which is visible in FIG. 1), the cavity being open at the bottom and rear for allowing insertion of the water jet apparatus.

The water jet apparatus comprises an inlet housing 18 which is slid into the aforementioned cavity and bolted to the hull by means of a top mounting plate 20 and a front plate 22. At the time of inlet housing installation, the drive shaft 26 is already rotatably mounted in a bore 96 formed in the inlet housing. During inlet housing installation, the front plate 22 is placed on the inside of the vertical hull section 14 and the inlet housing 18 is placed on the outside of vertical hull section 14, a set of three throughholes in the vertical hull section 14 and a set of three threaded holes in the inlet housing 18 being aligned with a set of three throughholes in the vertical hull section 14. Three screws 24 (only one of which is visible in FIG. 1) are passed through the aligned throughholes and screwed into the threaded holes of the inlet housing 18. The numeral 25 in FIG. 1 denotes a washer placed between the head of screw 24 and the front plate 22. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into throughholes in the hull. The front plate 22 is then positioned and screws 24 are screwed into the inlet housing 18. The top mounting plate 20 is then placed over the studs 28 and secured to the hull using nuts and washers.

In the assembled position, a front portion of the inlet housing 18 is sealed against the vertical hull section 14 by means of a seal 30 and a top portion of the inlet housing 18 is sealed against the horizontal hull section 12 by means of a seal 32. The seal 30 encompasses the interface where the openings in the vertical hull section 14 and inlet housing for the drive shaft 26 meet and is designed to prevent water leaking into the drive shaft assembly or into the boat via the opening 36. Similarly, the top mounting plate 20 has an opening 38 which, in the assembled state, is aligned with an opening 40 in the horizontal hull section 12 to allow a shift and steering housing 42 to be placed in a corresponding cavity in the top of the inlet housing 18. The shift and steering control system, which includes the shift and steering housing 42, will be described in detail later. The seal 32 encompasses the interface where the openings in the horizontal hull section 12 and inlet housing for the shift and steering housing 42 meet and is designed to prevent water leaking into the boat via the opening 38. In addition, a seal 31 is pressed between the inlet housing 18 and the hull along the front and sides of the inlet housing.

The inlet housing 18 has a water tunnel 44 with an inlet 46. The water tunnel 44 has a pair of sidewalls 48 (only one of which is shown in FIG. 1) which are generally coplanar with the sidewalls 8 of the hull inlet ramp 6. In addition, the water tunnel 44 has a guide surface 50 which starts at a point near where the ramp surface 10 of the hull inlet ramp 6 ends and then curves gradually upward in the aft direction. As a result of the foregoing structure, there is a generally smooth transition between the end of inlet ramp 6 and the beginning of water tunnel 44. Thus the hull 2 and the inlet housing 18 combine to form a single inlet for guiding water toward the inlet of a stator housing 52 located downstream of the inlet housing.

An inlet grate 54 extends across the inlet 46 of the water tunnel 44 and serves to block the admission of debris into the water jet apparatus. The inlet grate 54 comprises a multiplicity of generally parallel tines 56 which extend downward and rearward from an upper end of the inlet grate. Only the upper end of the inlet grate is attached to the inlet housing by screws (not shown). The cantilevered design is based on the theory that any weeds that wrap around the grate will be drawn down to the lower, open end and slide of f under the boat and/or be drawn into the pump and chopped up. In addition, a ride plate 58 is attached to the bottom of the inlet housing 18.

As shown in FIG. 1, the drive shaft projects in the aft direction out of the inlet housing 18. The impeller is pre-assembled in the unit prior to mounting in the hull. The hub and blades of impeller 60 are integrally formed as one cast piece. The hub of impeller 60 has a splined bore which meshes with splines formed on the external surface of the drive shaft 26, so that the impeller 60 will rotate in unison with the drive shaft 26. Also, a taper 60A on the impeller locks on to a taper 26A on the driveshaft to hold the impeller in place (see FIG. 3). The impeller 60 is held securely on the drive shaft 26 by a washer 62, which in turn is held in place by a lock nut 64 tightened onto a threaded end of the drive shaft 26. As seen in FIG. 1, the hub of the impeller 60 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The stator housing 52 comprises inner and outer shells connected by a plurality of stator vanes, all integrally formed as a single cast piece. The hub of the stator housing 52 gradually decreases in radius in the aft direction, starting out at a radius slightly less than the radius at the trailing edge of the impeller hub. The stator vanes are designed to redirect the swirling flow out of the impeller 60 into non-swirling flow. The stator housing hub has a radial end face with a central throughhole. Before the stator housing is installed, a tail cone cover 66 is attached to the radial end face of the stator housing hub by a screw 68. The front of the stator housing 52 is then attached to the rear of the inlet housing 18 by a plurality of screws (not shown in FIG. 1).

A circumferential recess in the stator housing 52 at a position opposing the impeller blade tips has a circular cylindrical wear ring 65 seated therein. Wear to the impeller blade tips is mainly due to the pumping of abrasives such as beach sand. The purpose of the wear ring 65 is to protect the soft aluminum casting with a hard stainless steel surface, thus drastically reducing the rate of wear.

After the stator housing 52 (with attached tail cone cover 66) has been attached to the inlet housing 18, the front of an exit nozzle 70 is attached to the rear of the stator housing 52 by screws. The front faces of the tail cone cover 66 and the exit nozzle 70 are preferably coplanar. The water flowing out of the stator housing 52 will flow through the space between the tail cone cover 66 and the exit nozzle 70, and then will exit the exit nozzle at its outlet.

The water jet apparatus shown in FIG. 1 is provided with a steering nozzle 72 which can change the direction of the water exiting the exit nozzle 70. This effect is used by the boat operator to steer the boat left or right. To accomplish this, the steering nozzle 72 is pivotably mounted to the exit nozzle 70 by a pair of pivot assemblies located at the top and bottom of the exit nozzle. Each pivot assembly comprises a screw 74, a sleeve (not visible in FIG. 1B) and a bushing 76. The axes of the screws 74 are collinear and form a vertical pivot axis about which the steering nozzle 72 can rotate. In particular, the steering nozzle has a pair of circular holes in which the bushings 76 are seated. The sleeves are inserted inside the respective bushings 76. The screws 74 are in turn inserted in the sleeves and screwed into respective threaded holes in the exit nozzle 70.

The water jet apparatus shown in FIG. 1 is also provided with a non-steerable reverse gate 80 which is pivotable between forward and reverse positions. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. This reverse flow of water will urge the boat in the aft direction. To accomplish the foregoing, the reverse gate 80 is pivotably mounted to the exit nozzle 70 by a pair of pivot assemblies located on opposite sides of the exit nozzle. Each pivot assembly has a construction substantially identical to the pivot assemblies previously described with reference to pivoting of the steering nozzle 72. Although not visible in FIG. 1, the reverse gate has a pair of arms, the ends of which are pivotably coupled to the respective pivot assemblies. The reverse gate has a design which allows the boat to steer in reverse in the same direction like an outboard, stern drive or car.

The respective positions of the steering nozzle and the reverse gate are controlled by the boat operator via a shift and steering control system which comprises shift and steering cables located inside the boat. Those cables are in turn respectively attached to the steering nozzle and reverse gate by respective levers, shafts and rods. The shafts penetrate the boat hull via the shift and steering housing 42 previously described. Portions of the shift control assembly are shown in FIG. 1; the steering control assembly, only steering cable 78 of which is shown in FIG. 1, has a similar construction. The shift control assembly comprises a shift cable 82 which is rotatably coupled to one end of an upper shift lever 86 by means of a clevis 84 and a clevis pin (not shown). The other end of the upper shift lever 86 is rigidly connected to an upper portion of a shift shaft 88, the latter being rotatably mounted in the shift and steering housing 42. A lower portion of the shift shaft 88 is rigidly connected to one end of a lower shift lever 90. The other end of the lower shift lever 90 is rotatably coupled to a fore end of a shift rod 92. The aft end of the shift rod 92 is in turn rotatably coupled to a pivot assembly (not shown) mounted on an arm (not shown) of the reverse gate 80. In response to operation of the shift cable 82, the reverse gate can be selectively raised from the reverse to the forward position or lowered from the forward to the reverse position, as desired.

Figure 2:
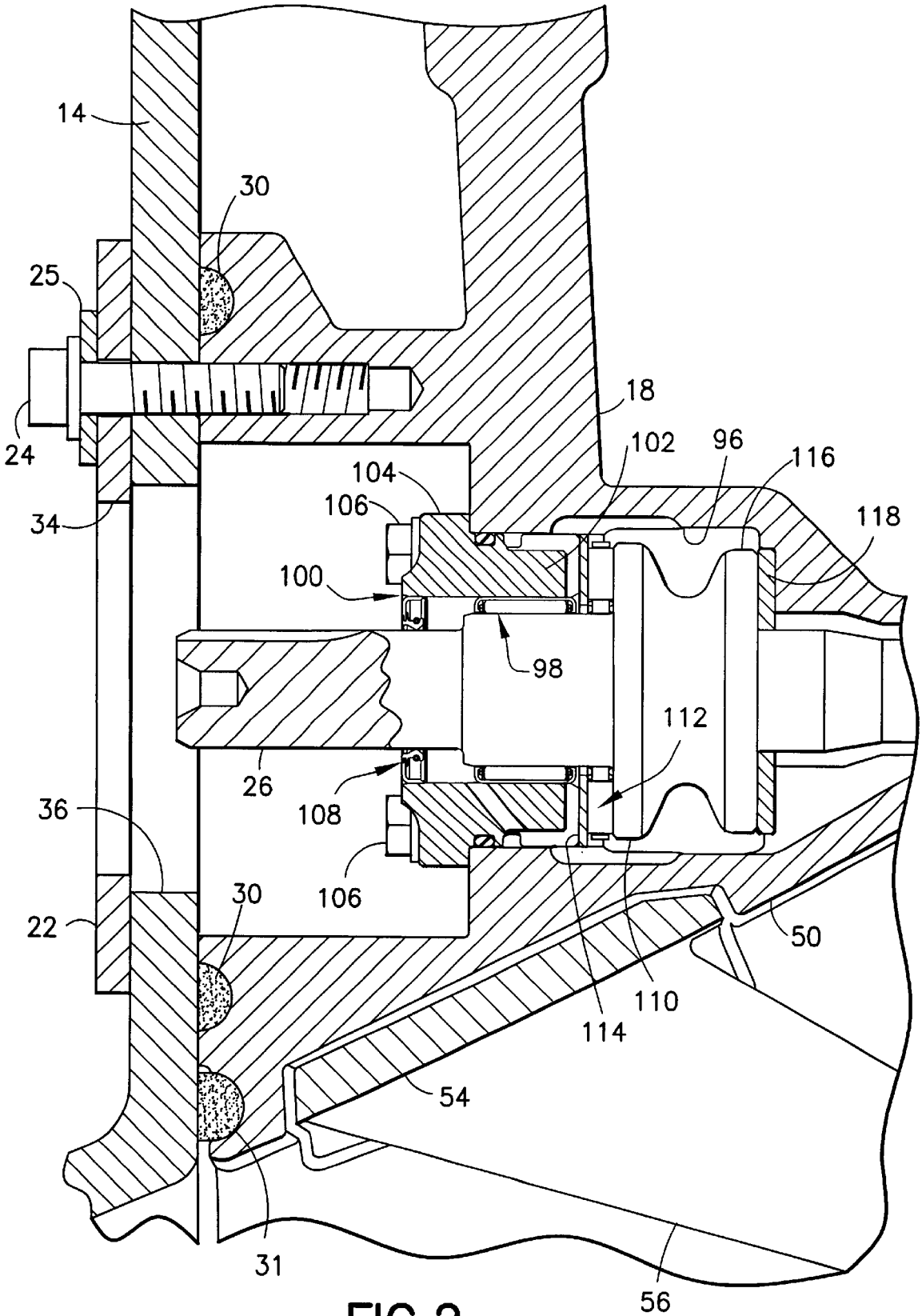
FIGS. 2 and 3 are schematics showing sectional views of the bearing arrangements for supporting the forward and aft ends respectively of the drive shaft in the embodiment shown in FIG. 1.
Figure 3:
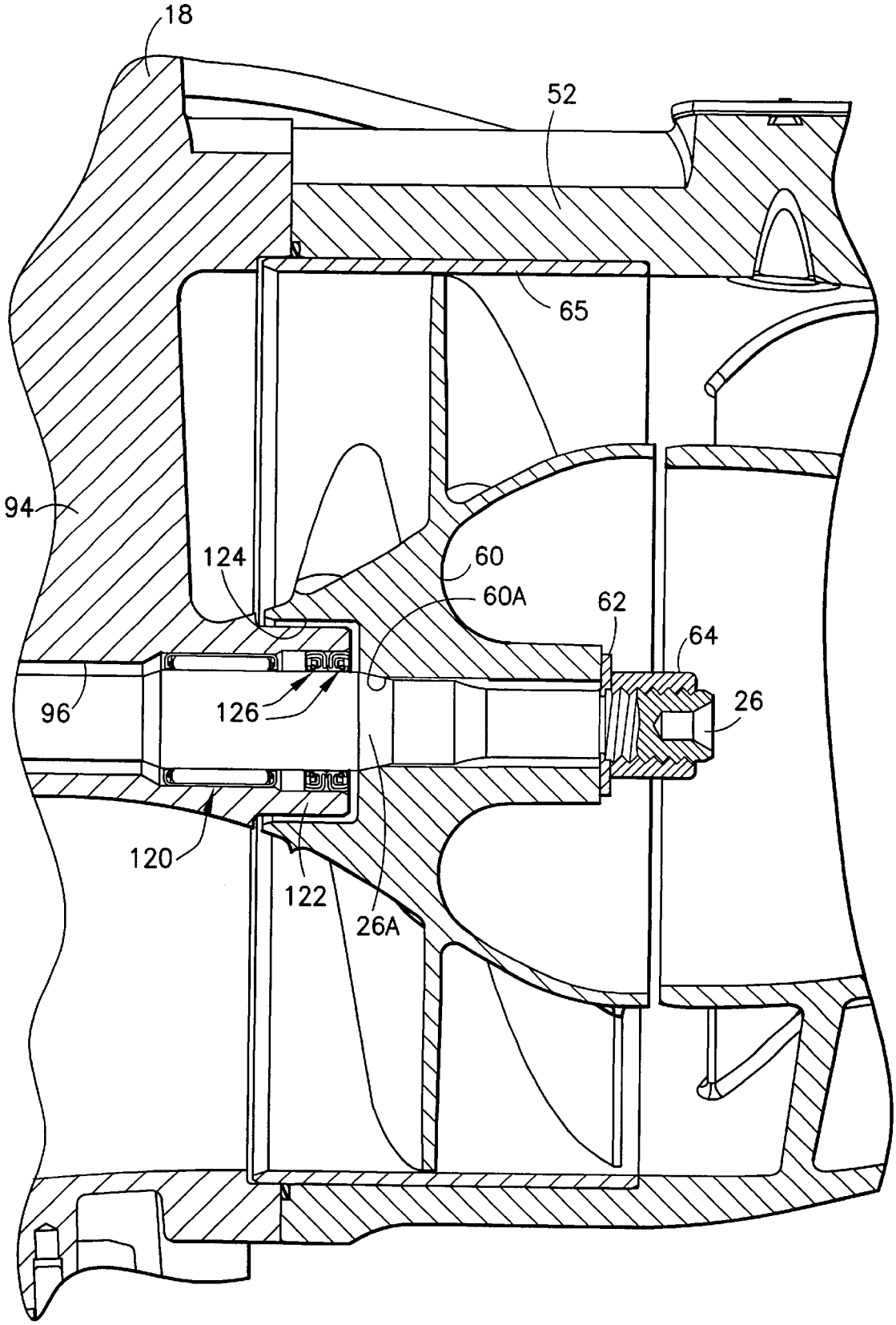
Figure 4:
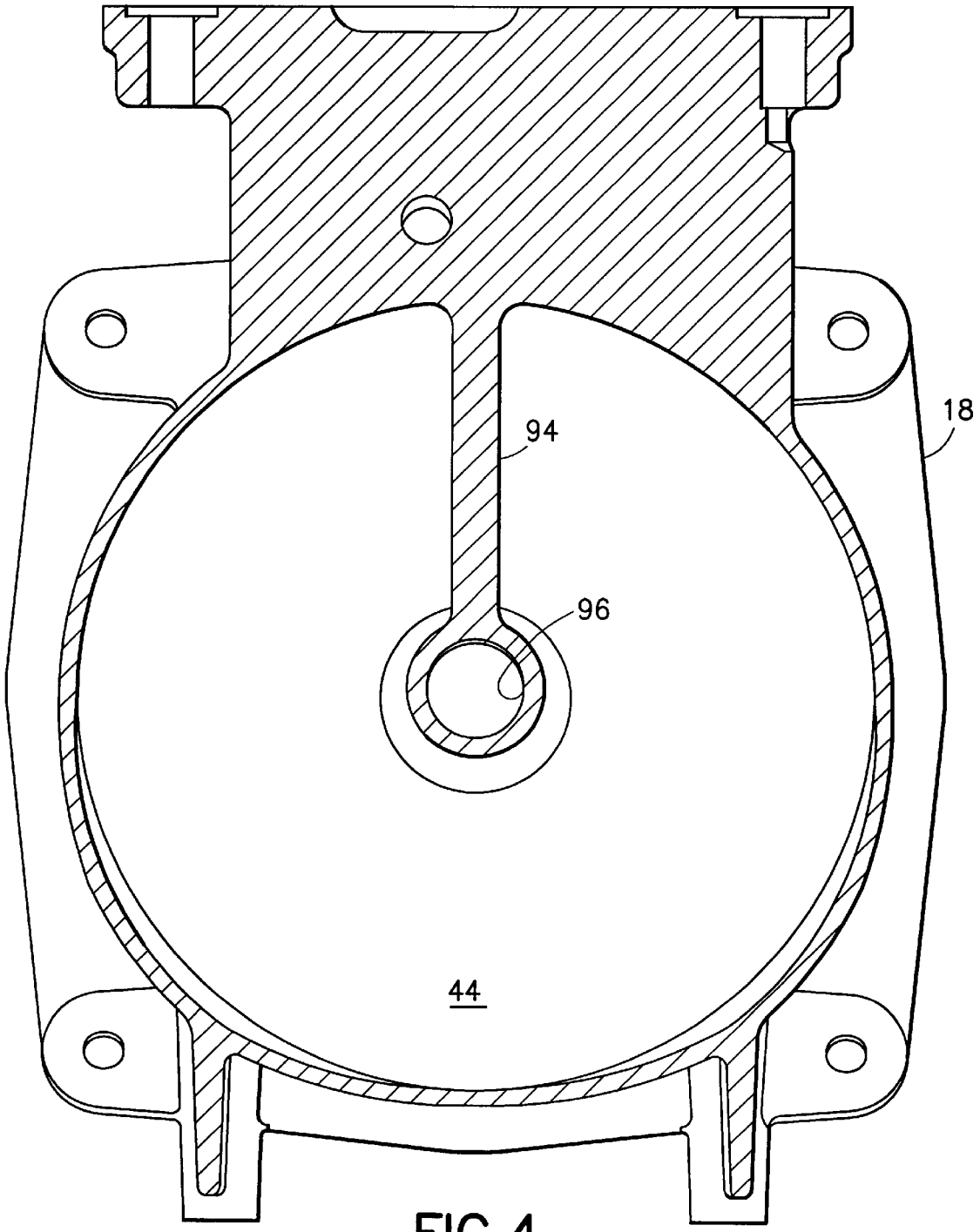
FIG. 4 is a schematic showing a sectional view of the inlet housing incorporated in the embodiment shown in FIG. 1, the section being taken along the a vertical plane through the inlet housing located at the centerline of the pin 38 (shown in FIG. 1A).

The preferred embodiment of the invention is shown in greater detail in FIGS. 2–4. Referring to FIG. 4, the inlet housing 18 comprises a vertical strut 94 having an axial bore 96 which houses a portion of the drive shaft. As seen in FIGS. 2 and 3 respectively, both ends of the drive shaft project out of the bore 96.

Referring to FIG. 2, toward the forward end of the drive shaft, the drive shaft is rotatably supported by a forward needle bearing assembly 98 installed in an annular space between the drive shaft 26 and a bearing housing 100. The bearing housing 100 in turn has a generally annular portion 102 which extends into an annular cavity formed between the inlet housing 18 and the needle bearing 98, and a generally radial flange 104 with apertured bosses (not shown) for fastening the bearing housing to the inlet housing by means of screws 106, only two of which are shown in FIG. 2. Forward of the needle bearing 98, an oil seal 108 is installed in an annular space between the bearing housing 100 and the drive shaft 26.

As seen in FIG. 2, the drive shaft has a forward radial flange 110 with a forward radial surface which serves as a bearing surface as the drive shaft is thrust forward during impeller rotation. The rotating bearing surface rides on a thrust bearing assembly 112, which in turn rolls on the annular surface of a forward thrust washer 114. The forward thrust washer 114 abuts against the annular rear face of the bearing housing 100. [This is difficult to visualize in FIG. 2 because the hatched portion of the bearing housing is separated from the forward thrust washed by a pair of unhatched L-shaped oil channels formed in the bearing housing.]The drive shaft also has an aft radial flange 116 with a rear surface which bears against an aft thrust washer 118 in the event that the drive shaft is thrust in the aft direction, e.g., as the result of the impact of a wave. The aft thrust washer 118 is seated in an annular offset formed in the inlet housing.

Referring to FIG. 3, the aft end of the drive shaft 26 is rotatably supported by an aft needle bearing assembly 120 which is installed in an annular space formed between the drive shaft 26 and the inlet housing 18. The inlet housing comprises a generally annular projection 122 which extends in the aft direction into a cavity 124 formed in the forward section of the impeller hub. A pair of oil seals 126 are installed between the distal end of the generally annular projection 122 of the inlet housing and the drive shaft 26. As seen in FIG. 3, the oil seals 126 lie within the impeller cavity 124. The impeller 60 is held securely on the drive shaft 26 by a washer 62 and a lock nut 64, which is screwed onto the threaded end of the drive shaft.

Figure 5:
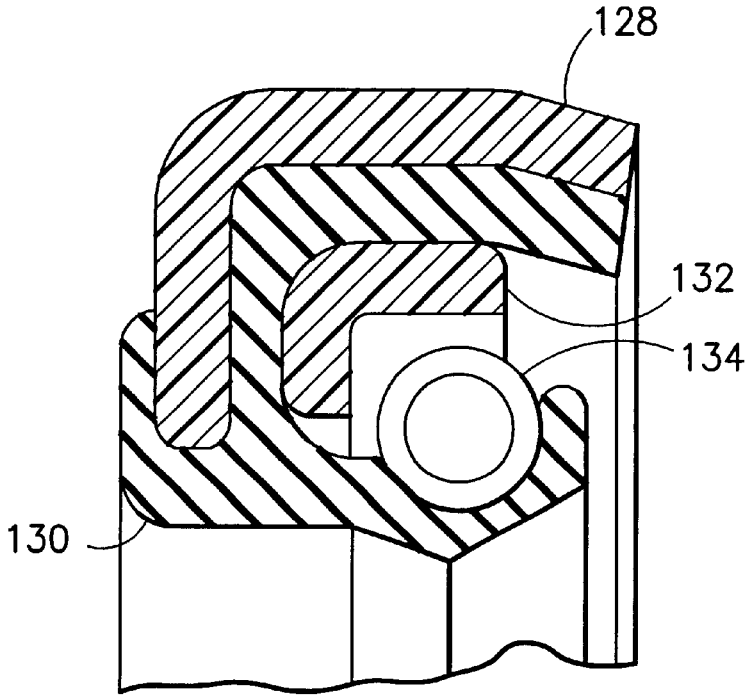
FIG. 5 is a schematic showing a sectional view of an oil-retaining seal of the type seen in FIG. 3.
Figure 6:
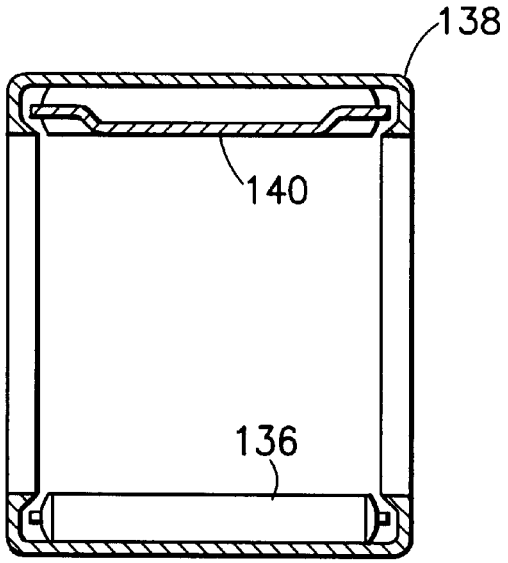
FIG. 6 is a schematic showing a sectional view of a needle bearing assembly of the type seen in FIGS. 2 and 3.

In accordance-with the preferred embodiment, the oil seals and needle bearing assemblies are of the types respectively shown in FIGS. 5 and 6. Referring to FIG. 5, each oil seal comprises a metal (preferably stainless steel) outer shell 128 and inner band 132 and a rubber seal 130 One portion of the seal 130 is held between the outer shell and inner band, while the other portion of the seal is in rubbing contact with the drive shaft. A circular coil spring 134 (also preferably made of stainless steel) presses a portion of the seal 130 against the drive shaft. The seal is intended to prevent oil leakage out of the inlet housing bore and water leakage into the inlet housing bore for the drive shaft. Referring to FIG. 6, each needle bearing assembly comprises a multiplicity of circular cylindrical rollers circumferentially distributed in a raceway 138 and held in respective positions by a cage 140.

In accordance with the preferred embodiment of the invention, the forward end of the drive shaft 26 (best seen in FIG. 2) will be coupled to the end of the output shaft (not shown) from an inboard motor. The drive shaft is always driven to rotate in the forward direction. If the boat operator wishes to go in reverse, then the reverse gate 80 will be lowered into the reverse position shown in FIG. 1. In accordance with the preferred embodiment of the invention, the drive shaft is rotatably supported only by bearing assemblies installed in the inlet housing. The impeller is mounted on a distal section of the drive shaft having no bearing support aft of the impeller. As a result, the assembly of the water jet apparatus is simplified since no bearing assemblies need to be installed in the stator housing.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A water jet apparatus comprising:

an inlet housing formed as a single cast piece and comprising an inlet opening and a vertical strut with a generally annular projection penetrated by a bore, said projection extending rearward away from said inlet opening;

first and second bearing assemblies installed within said inlet housing;

a drive shaft rotatably supported by said first and second bearing assemblies and comprising a first axial portion which resides in said bore of said projection and a second axial portion which extends beyond an end of said projection; and an impeller comprising a hub having an outer circumferential surface which increases in radius in a rearward direction and a plurality of impeller blades extending outward from said hub, said impeller hub comprising a first hub axial portion which is mounted on said drive shaft and a second hub axial portion which encompasses at least a portion of said projection, wherein said second hub axial portion is forward of said first hub axial portion.

2. The water jet apparatus as recited in claim 1, further comprising an oil seal arranged in an annular space between said inlet housing projection and said first axial portion of said drive shaft.

3. The water jet apparatus as recited in claim 1, further comprising a lock nut screwed onto a threaded end of said second axial portion of said drive shaft, and a washer sandwiched between an end face of said impeller hub and said lock nut.

4. The water jet apparatus as recited in claim 1, further comprising a stator housing attached to said inlet housing and comprising an axial portion which surrounds said impeller and a stator hub having a profile at its forward edge which matches a profile at a rearward edge of said impeller hub.

5. The water jet apparatus as recited in claim 4, wherein said stator hub is hollow and said drive shaft is not rotatably supported inside said hollow stator hub.

6. A water jet apparatus comprising:

an inlet housing formed as a single cast piece comprising an inlet opening and a vertical strut;

a stator housing attached to said inlet housing and comprising a plurality of stator vanes;

first and second bearing assemblies supported by said inlet housing;

a drive shaft rotatably supported by said first and second bearing assemblies, and extending outside said inlet housing and into said stator housing; and an impeller mounted on said drive shaft and surrounded by said stator housing with said stator vanes rearward of said impeller, wherein the portion of said drive shaft extending outside said inlet housing and into said stator housing is not supported by said stator housing, and wherein said inlet housing comprises a generally annular portion which encircles a first axial portion of said drive shaft, and said impeller comprises a first hub axial portion which encircles said generally annular portion of said inlet housing and a second hub axial portion which encircles a second axial portion of said drive shaft.

7. The water jet apparatus as recited in claim 6, further comprising an oil seal arranged in an annular space between said generally annular portion of said inlet housing and said first axial portion of said drive shaft.

8. The water jet apparatus as recited in claim 6, further comprising a lock not screwed onto a threaded end of said second axial section of said drive shaft, and a washer sandwiched between an end face of said impeller hub and said lock nut.

9. The water jet apparatus as recited in claim 6, wherein said stator housing comprises a hollow stator hub having a profile at its forward edge which matches the profile at a rearward edge of said impeller hub and having no bearing installed therein.

10. A water jet apparatus comprising:

a drive shaft having first and second ends;

means for housing a first axial portion of said drive shaft not including either of said first and second ends;

means for rotatably supporting said drive shaft within said housing means; and an impeller comprising a first hub axial portion which is mounted on a second axial portion of said drive shaft, said second axial portion being between said first axial portion and said second end of said drive shaft, wherein said housing means comprises an aft portion which encircles a part of said first axial portion, and said impeller comprises a second hub axial portion which encircles said aft portion of said housing means and is forward of said first hub axial portion, further comprising a stator housing attached to said inlet housing and comprising a shell which surrounds said impeller and a stator hub having a profile at its forward edge which matches a profile at a rearward edge of said impeller hub.

11. The water jet apparatus as recited in claim 10, further comprising an oil seal arranged in an annular space between said aft portion of said housing means and said first axial portion of said drive shaft.

12. The water jet apparatus as recited in claim 10, further comprising a lock nut screwed onto said second end of said drive shaft, and a washer sandwiched between an end face of said impeller hub and said lock nut.

13. The water jet apparatus as recited in claim 10, wherein said stator hub is hollow and said drive shaft is not rotatably supported inside said hollow stator hub.

14. A water jet apparatus comprising:

a monolithic inlet housing comprising a tubular portion having a bore and a cavity in communication with said bore, said cavity having a diameter greater than a diameter of said bore, and a strut for supporting said tubular portion;

a bearing housing attached to said inlet housing and extending inside said cavity;

a drive shaft penetrating said bore, said cavity and said bearing housing, said drive shaft comprising a rear end which extends rearwardly beyond said tubular portion and which is not in contact with any bearing assembly;

first and second bearing assemblies for rotatably supporting said drive shaft along sections of said drive shaft which are forward of said rear end, said first bearing assembly being housed in said bearing housing and said second bearing assembly being housed inside said tubular portion; and an impeller comprising a hub mounted to said rear end of said drive shaft.

15. The water jet apparatus as recited in claim 14, wherein said drive shaft comprises a radial flange located inside said cavity, further comprising a thrust bearing assembly arranged between said radial flange of said drive shaft and said bearing housing.

16. The water jet apparatus as recited in claim 15, further comprising a thrust washer arranged between said thrust bearing assembly and said bearing housing.

17. The water jet apparatus as recited in claim 14, wherein said hub comprises a first hub axial portion which is mounted to said drive shaft and a second hub axial portion forward of said first hub axial portion, said second axial portion encircling an aft most portion of said tubular portion of said inlet housing.

18. The water jet apparatus as recited in claim 17, further comprising an oil seal arranged in an annular space between said aft most portion of said tubular portion of said inlet housing and said drive shaft.

* * * * *

UNITED STATES PATENT AND TRADEMARK OFFICE

CERTIFICATE OF CORRECTION

PATENT NO. : 6,287,162 B1
DATED : September 11, 2001
INVENTOR(S) : Michael W. Freitag, Paul E. Westhoff and Richard M. McChesney It is certified that error appears in the above-identified patent and that said Letters Patent is hereby corrected as shown below:

Column 2,
Line 40, delete the second occurrence of the word "the".

Column 4,
Line 1, delete the space between the word "of" and the letter "f".

Column 6,
Line 33, insert a period after the number "130".

Column 8, claim 9,
Line 13, change the word "bearing" to -- bearings --.

Signed and Sealed this

Twelfth Day of March, 2002

*Attest:*

*Attesting Officer*

JAMES E. ROGAN
*Director of the United States Patent and Trademark Office*